US009702128B2

(12) United States Patent
Sawaski

(10) Patent No.: US 9,702,128 B2
(45) Date of Patent: Jul. 11, 2017

(54) FAUCET INCLUDING CAPACITIVE SENSORS FOR HANDS FREE FLUID FLOW CONTROL

(71) Applicant: MASCO CORPORATION OF INDIANA, Indianapolis, IN (US)

(72) Inventor: Joel D. Sawaski, Indianapolis, IN (US)

(73) Assignee: Delta Faucet Company, Indianapolis, IN (US)

( * ) Notice: Subject to any disclaimer, the term of this patent is extended or adjusted under 35 U.S.C. 154(b) by 232 days.

(21) Appl. No.: 14/575,925

(22) Filed: Dec. 18, 2014

(65) Prior Publication Data

US 2016/0177550 A1 Jun. 23, 2016

(51) Int. Cl.
*E03C 1/05* (2006.01)

(52) U.S. Cl.
CPC ..... *E03C 1/057* (2013.01)

(58) Field of Classification Search
CPC ..... E03C 1/057; E03C 1/04; E03C 1/0404; E03C 2001/026; G05D 7/0635; G05D 23/1917
USPC ..... 4/623; 251/129.04
See application file for complete search history.

(56) References Cited

U.S. PATENT DOCUMENTS

| | | | |
|---|---|---|---|
| 3,505,692 | A | 4/1970 | Forbes |
| 4,716,605 | A | 1/1988 | Shepherd et al. |
| 4,823,414 | A | 4/1989 | Piersimoni et al. |
| 5,549,273 | A | 8/1996 | Aharon |
| 5,670,945 | A | 9/1997 | Applonie |
| 5,694,653 | A | 12/1997 | Harald |
| 6,452,514 | B1 | 9/2002 | Philipp |
| 6,962,168 | B2 | 11/2005 | McDaniel et al. |
| 6,968,860 | B1 | 11/2005 | Haenlein et al. |
| 7,104,519 | B2 | 9/2006 | O'Maley et al. |
| 7,150,293 | B2 | 12/2006 | Jonte |
| 7,232,111 | B2 | 6/2007 | McDaniel et al. |
| 7,458,520 | B2 | 12/2008 | Belz et al. |
| 7,537,023 | B2 | 5/2009 | Marty et al. |
| 7,537,195 | B2 | 5/2009 | McDaniel et al. |

(Continued)

FOREIGN PATENT DOCUMENTS

| | | |
|---|---|---|
| WO | WO 2007/082301 | 7/2007 |
| WO | WO 2008/094651 | 8/2008 |

(Continued)

OTHER PUBLICATIONS

Leonardo Bonanni et al.; "Context-Aware Work Surfaces"; MIT Media Laboratory; Sep. 21, 2004.

*Primary Examiner* — Marina Tietjen
(74) *Attorney, Agent, or Firm* — Faegre Baker Daniels LLP

(57) ABSTRACT

A faucet comprises a spout, a passageway that conducts water flow through the spout, and an electrically operable valve disposed within the passageway. A first capacitive sensor has a first detection field that generates a first output signal upon detection of a user's hands in the first detection field, and a second capacitive sensor has a second detection field that generates a second output signal upon detection of a user's hands in the second detection field. The first and second detection fields overlap to define a detection zone. A controller is coupled to the first and second capacitive sensors and the electrically operable valve. The controller is programmed to actuate the electrically operable valve in response to detecting the user's hands in the detection zone.

8 Claims, 5 Drawing Sheets

(56) References Cited

U.S. PATENT DOCUMENTS

| | | | | |
|---|---|---|---|---|
| 7,631,372 | B2 | 12/2009 | Marty et al. | |
| 7,690,395 | B2 | 4/2010 | Jonte et al. | |
| 7,806,141 | B2 | 10/2010 | Marty et al. | |
| 7,997,301 | B2 | 8/2011 | Marty et al. | |
| 8,028,355 | B2 | 10/2011 | Reeder et al. | |
| 8,127,782 | B2 | 3/2012 | Jonte et al. | |
| 8,162,236 | B2 | 4/2012 | Rodenbeck et al. | |
| 8,376,313 | B2 | 2/2013 | Burke et al. | |
| 8,424,569 | B2 | 4/2013 | Marty et al. | |
| 8,438,672 | B2 | 5/2013 | Reeder et al. | |
| 8,469,056 | B2 | 6/2013 | Marty et al. | |
| 8,528,579 | B2 | 9/2013 | Jonte et al. | |
| 8,561,626 | B2 | 10/2013 | Sawaski et al. | |
| 8,613,419 | B2 | 12/2013 | Rodenbeck et al. | |
| 8,776,817 | B2 | 7/2014 | Sawaski et al. | |
| 8,844,564 | B2 | 9/2014 | Jonte et al. | |
| 8,939,429 | B2 | 1/2015 | Sawaski et al. | |
| 8,944,105 | B2 | 2/2015 | Rodenbeck et al. | |
| 8,973,612 | B2 | 3/2015 | Sawaski et al. | |
| 2004/0025248 | A1* | 2/2004 | Lang | E03C 1/14 4/623 |
| 2005/0199841 | A1* | 9/2005 | O'Maley | E03C 1/057 251/129.04 |
| 2007/0057215 | A1* | 3/2007 | Parsons | E03C 1/05 251/129.04 |
| 2007/0170384 | A1* | 7/2007 | Goodman | E03C 1/057 251/129.04 |
| 2009/0056011 | A1* | 3/2009 | Wolf | E03C 1/057 4/623 |
| 2010/0089472 | A1* | 4/2010 | Meza | E03C 1/04 137/544 |
| 2010/0108165 | A1 | 5/2010 | Rodenbeck et al. | |
| 2010/0170570 | A1 | 7/2010 | Rodenbeck et al. | |
| 2012/0017367 | A1* | 1/2012 | Reeder | E03C 1/057 4/597 |
| 2012/0055557 | A1 | 3/2012 | Belz et al. | |
| 2012/0227849 | A1 | 9/2012 | Rodenbeck et al. | |
| 2013/0100033 | A1 | 4/2013 | Yuan et al. | |
| 2013/0146160 | A1 | 6/2013 | Davidson et al. | |
| 2013/0186196 | A1 | 7/2013 | Veros et al. | |
| 2013/0276911 | A1 | 10/2013 | Meehan et al. | |
| 2014/0000733 | A1 | 1/2014 | Jonte et al. | |
| 2014/0109984 | A1 | 4/2014 | Rodenbeck et al. | |
| 2014/0261750 | A1 | 9/2014 | Rosko et al. | |
| 2014/0326321 | A1 | 11/2014 | Sawaski et al. | |
| 2014/0352799 | A1 | 12/2014 | Rosko et al. | |
| 2014/0359935 | A1 | 12/2014 | Veros et al. | |
| 2015/0013064 | A1 | 1/2015 | Marty et al. | |
| 2015/0074893 | A1 | 3/2015 | Veros et al. | |

FOREIGN PATENT DOCUMENTS

| | | |
|---|---|---|
| WO | WO 2008/118402 | 10/2008 |
| WO | WO 2009/075858 | 6/2009 |
| WO | WO 2011/133665 | 10/2011 |
| WO | WO 2013/086206 | 6/2013 |
| WO | WO 2013/086217 | 6/2013 |
| WO | WO 2014/150123 | 9/2014 |

* cited by examiner

FAUCET INCLUDING CAPACITIVE SENSORS FOR HANDS FREE FLUID FLOW CONTROL

BACKGROUND AND SUMMARY

The present disclosure relates generally to improvements in capacitive sensors for activation of faucets. More particularly, the present invention relates to the placement of a capacitive sensors in or adjacent to faucet spouts and/or faucet handles to sense proximity of a user of the faucet and then control the faucet based on output signals from the capacitive sensors.

Electronic faucets are often used to control fluid flow. Electronic faucets may include proximity sensors such as active infrared ("IR") proximity detectors or capacitive proximity sensors. Such proximity sensors are used to detect a user's hands positioned near the faucet, and turn the water on and off in response to detection of the user's hands. Other electronic faucets may use touch sensors to control the faucet. Such touch sensors include capacitive touch sensors or other types of touch sensors located on a spout of the faucet or on a handle for controlling the faucet. Capacitive sensors on the faucet may also be used to detect both touching of faucet components and proximity of the user's hands adjacent the faucet.

In one illustrated embodiment of the present disclosure, a faucet comprises a spout, a passageway that conducts water flow through the spout, and an electrically operable valve disposed within the passageway. A first capacitive sensor has a first detection field that generates a first output signal upon detection of a user's hands in the first detection field, and a second capacitive sensor has a second detection field that generates a second output signal upon detection of a user's hands in the second detection field. The first and second detection fields overlap to define a detection zone. A controller is coupled to the first and second capacitive sensors and the electrically operable valve. The controller is programmed to actuate the electrically operable valve in response to detecting the user's hands in the detection zone.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
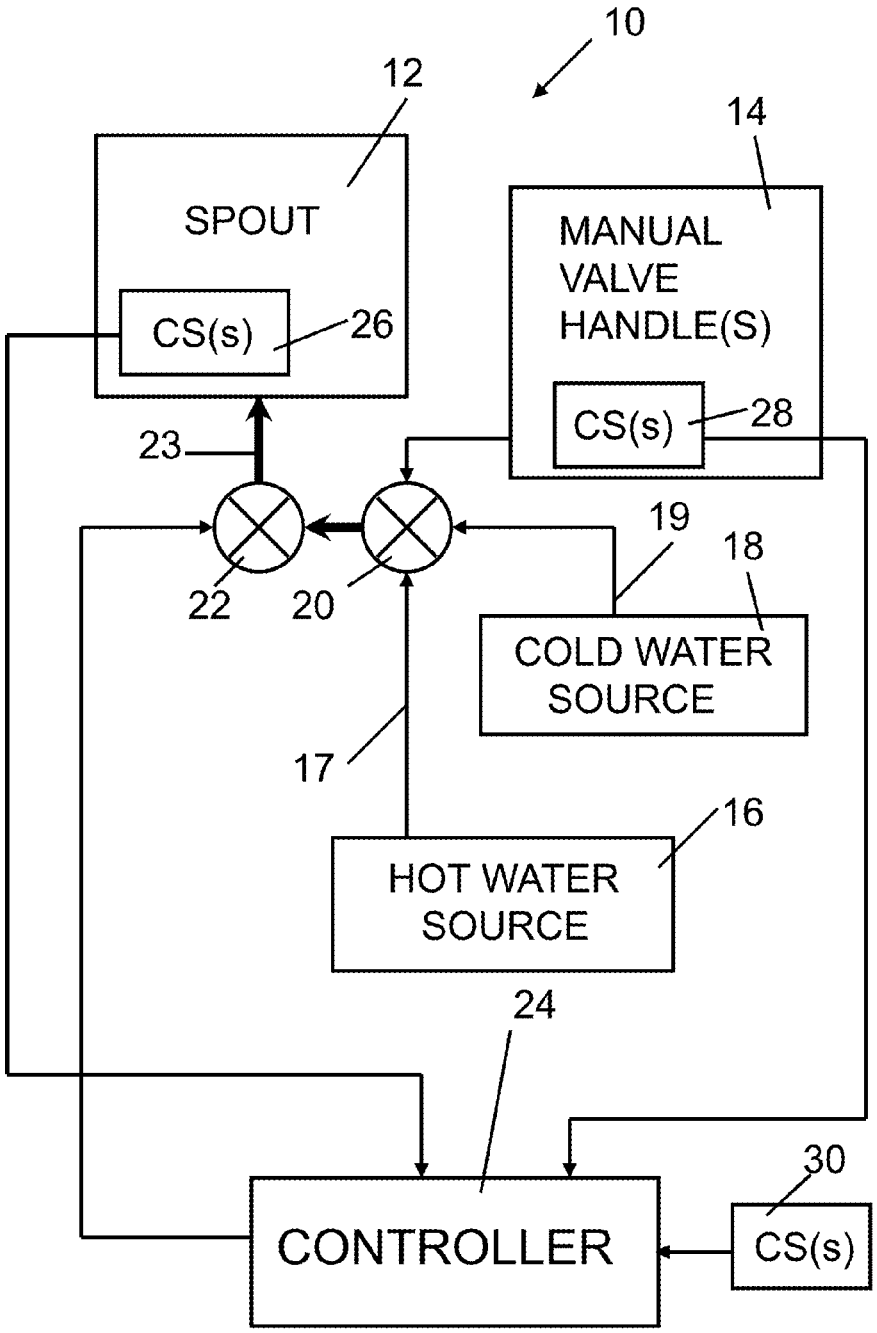
FIG. 1 is a block diagram of an illustrated embodiment of an electronic faucet.

For the purposes of promoting an understanding of the principles of the present disclosure, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of the principles of the invention which would normally occur to one skilled in the art to which the invention relates.

FIG. 1 is a block diagram showing one illustrative embodiment of an electronic faucet 10 of the present disclosure. The faucet 10 illustratively includes a spout 12 for delivering fluids such as water and at least one manual valve handle 14 for controlling the flow of fluid through the spout 12 in a manual mode. A hot water source 16 and cold water source 18 are coupled to a manual valve body assembly 20 by fluid supply lines 17 and 19, respectively. The valve handle 14 is operably coupled to the manual valve body assembly 20 to control water flow therethrough.

In one illustrated embodiment, separate manual valve handles 14 are provided for the hot and cold water sources 16, 18. In other embodiments, such as a kitchen faucet embodiment, a single manual valve handle 14 is used for both hot and cold water delivery. In such kitchen faucet embodiment, the manual valve handle 14 and spout 12 are typically coupled to a basin through a single hole mount. An output of valve body assembly 20 is coupled to an actuator driven valve 22 which is controlled electronically by input signals received from a controller 24. In an illustrative embodiment, actuator driven valve 22 is an electrically operable valve, such as a solenoid valve. An output of actuator driven valve 22 supplies fluid to the spout 12 through supply line 23.

In an alternative embodiment, the hot water source 16 and cold water source 18 are connected directly to actuator driven valve 22 to provide a fully automatic faucet without any manual controls. In yet another embodiment, the controller 24 controls an electronic proportioning valve (not shown) to supply fluid to the spout 12 from hot and cold water sources 16, 18.

Because the actuator driven valve 22 is controlled electronically by controller 24, flow of water is controlled using outputs from sensors such as capacitive sensors 26, 28 and/or 30. As shown in FIG. 1, when the actuator driven valve 22 is open, the faucet 10 may be operated in a conventional manner, i.e., in a manual control mode through operation of the handle(s) 14 and the manual valve member of valve body assembly 20. Conversely, when the manually controlled valve body assembly 20 is set to select a water temperature and flow rate, the actuator driven valve 22 can be touch controlled, or activated by proximity sensors when an object (such as a user's hands) are within a detection zone to toggle water flow on and off.

In one illustrated embodiment, spout 12 has at least one capacitive sensor 26 connected to controller 24. In addition, the manual valve handle(s) 14 may also have capacitive sensor(s) 28 mounted thereon which are electrically coupled to controller 24. Additional capacitive sensors 30 may be located near the spout 10, such as in an adjacent sink basin.

The output signals from capacitive sensors 26, 28 and/or 30 are used to control actuator driven valve 22 which thereby controls flow of water to the spout 12 from the hot and cold water sources 16 and 18. By sensing capacitance changes with capacitive sensors 26, 28, the controller 24 can make logical decisions to control different modes of operation of faucet 10 such as changing between a manual mode of operation and a hands free mode of operation as further described in U.S. Pat. Nos. 8,613,419; 7,690,395 and 7,150,293; and 7,997,301, the disclosures of which are all expressly incorporated herein by reference. Another illustrated configuration for a proximity detector and logical control for the faucet in response to the proximity detector is described in greater detail in U.S. Pat. No. 7,232,111, which is hereby incorporated by reference in its entirety.

The amount of fluid from hot water source 16 and cold water source 18 is determined based on one or more user inputs, such as desired fluid temperature, desired fluid flow rate, desired fluid volume, various task based inputs, various recognized presentments, and/or combinations thereof. As discussed above, the faucet 10 may also include an electronically controlled proportioning or mixing valve which is in fluid communication with both hot water source 16 and cold water source 18. Exemplary electronically controlled mixing valves are described in U.S. Pat. No. 7,458,520 and PCT International Publication No. WO 2007/082301, the disclosures of which are expressly incorporated by reference herein.

The present disclosure relates generally to faucets including hands free flow control and, more particularly, to a faucet including at least two capacitive sensors to detect a user's hands in a detection zone to control water flow. It is known to provide capacitive sensors on faucet components which create a detection zone near the faucet. When a user's hands are detected in the detection zone, the capacitive sensor signals a controller to turn on the flow of water to the faucet. See, for example, Masco's U.S. Pat. No. 8,127,782; U.S. Patent Application Publication No. 2010/0170570; or U.S. Patent Application Publication No. 2010/0108165.

Figure 2:
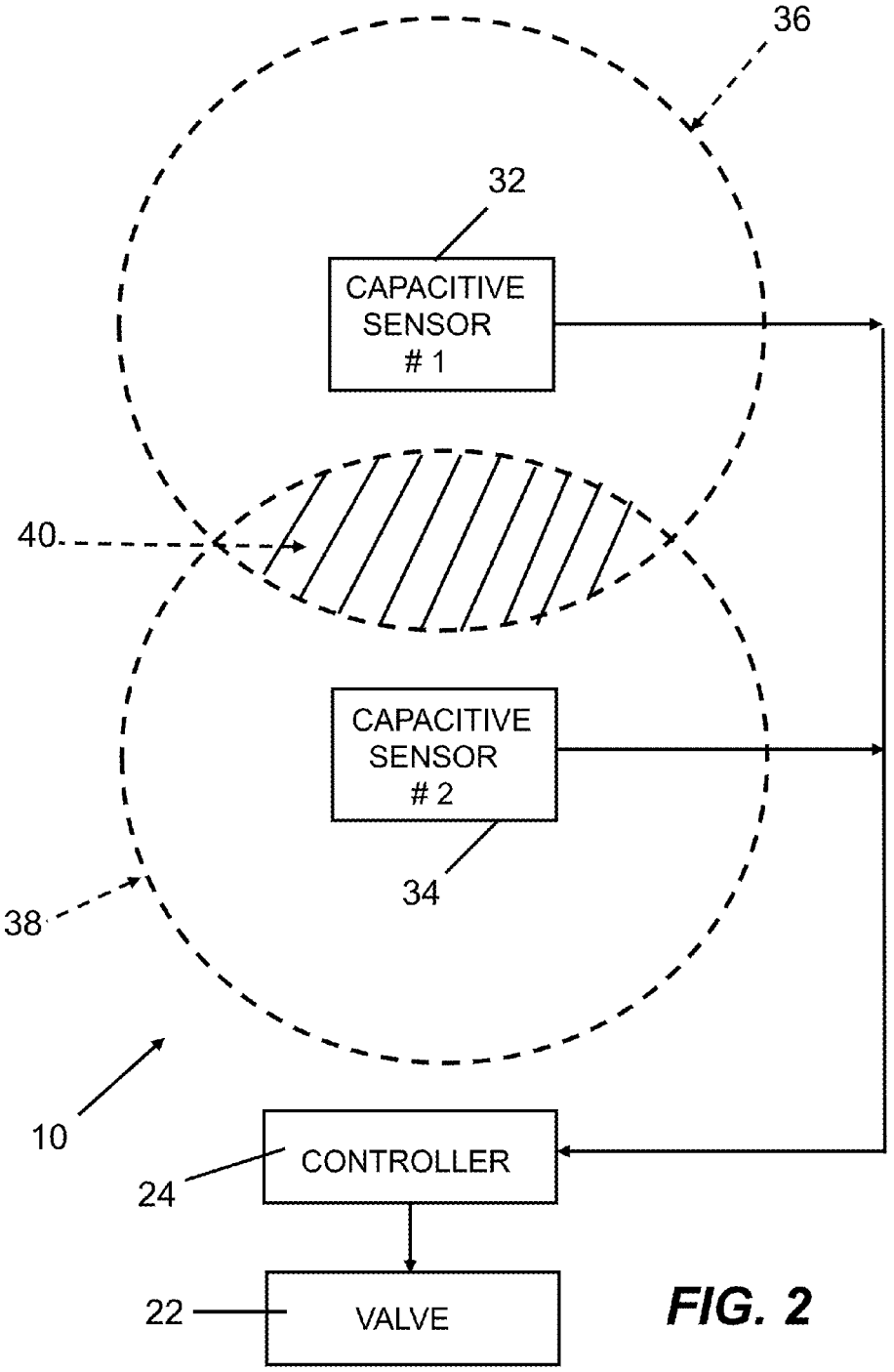
FIG. 2 is a block diagram illustrating an embodiment of the present disclosure including first and second capacitive sensors each having a separate detection field positioned to define an overlapping central detection region or detection zone, wherein a controller processes output signals from the first and second capacitive sensors to detect when a user is positioned within the detection zone.

FIG. 2 illustrates an embodiment of an electronic faucet system 10 of the present disclosure including a hands-free capacitive sensing system. The system 10 includes a controller 24 and first and second capacitive sensors 32 and 34 located on or near the faucet and coupled to the controller 24. The first capacitive sensor 32 has a generally spherical detection field 36 surrounding sensor 32, and the second capacitive sensor 34 has a generally spherical detection field 38 surrounding sensor 34. Capacitive sensors 32 and 34 detect objects, such as the user's hands, anywhere in the entire spherical detection regions 36 and 38, respectively. As shown in FIG. 2, detection field 36 overlaps detection field 38 in a generally prolate spheroid or "football" shaped region or detection zone 40. The controller 24 processes output signals from the first and second capacitive sensors 32 and 34 to detect when a user's hands are positioned within the detection zone 40. When the user's hands are detected in overlapping detection zone 40, controller 24 opens a valve 22 to provide fluid flow to an outlet of the faucet.

Figure 3:
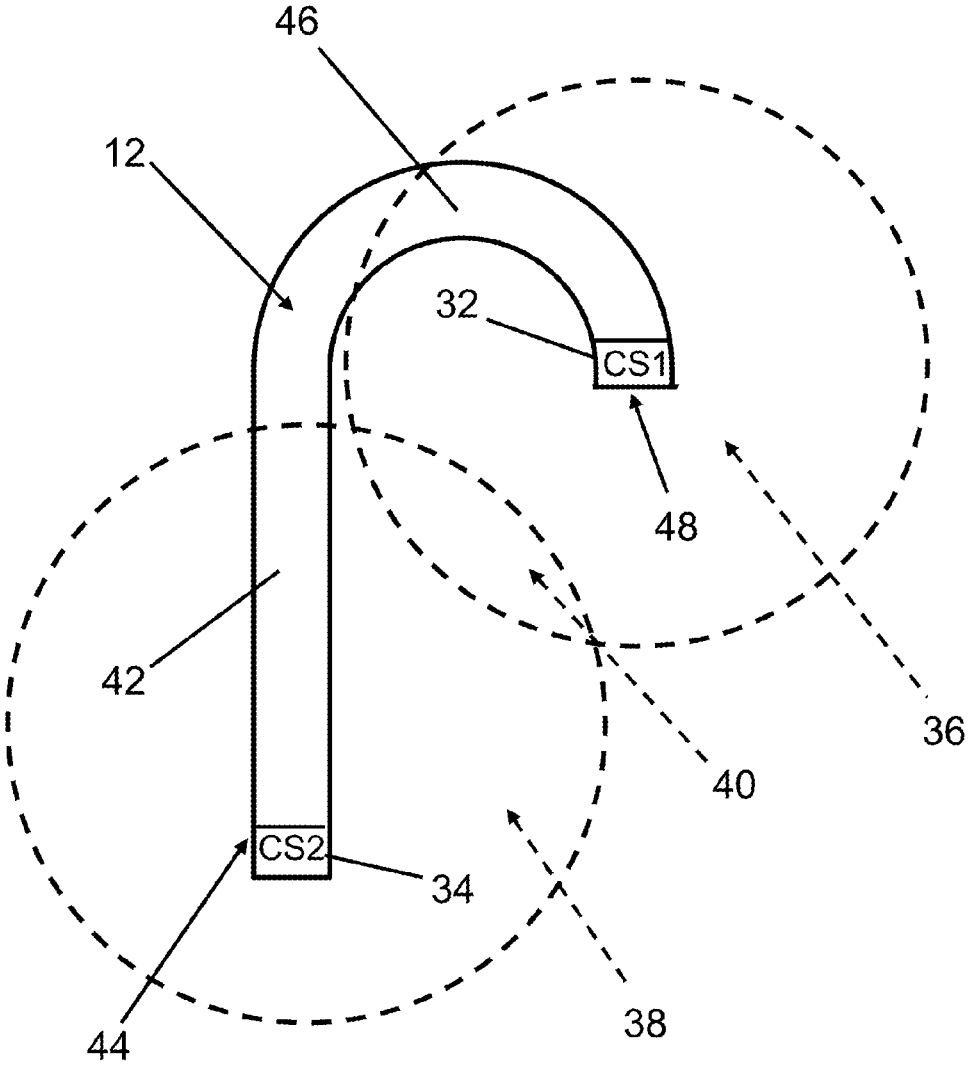
FIG. 3 is a block diagram illustrating the first and second capacitive sensors of FIG. 2 positioned on a spout of a faucet to define a detection zone adjacent the spout.

FIG. 3 illustrates the embodiment of FIG. 2 in which the capacitive sensors 32 and 34 are both coupled to a spout 12 of the faucet. Illustratively, the spout includes an upwardly extending portion 42 which is pivotably mounted to a hub 44 so that the spout 12 can swivel about an axis of the upwardly extending portion 42. Spout 12 further includes a curved portion 46 and an outlet 48 so that the spout 12 generally has an inverted J-shape.

Illustratively, the first capacitive sensor 32 is coupled to the spout 12 near outlet 48. The second capacitive sensor 34 is coupled to hub 44 or a lower section of upwardly extending portion 42 of spout 12. As discussed above, detection field 36 of capacitive sensor 32 and detection field 38 of capacitive sensor 34 overlap to define a detection zone 40. The first and second sensors 32 and 34 are positioned on the spout 12 so that the detection zone 40 is positioned at a desired location for detecting the user's hands. For instance, the detection zone 40 may be located near the outlet 48 of spout 12. In one embodiment, the detection zone 40 is beneath the curved portion 46 of spout 12 between the upwardly extending portion 42 and the outlet 48. Therefore, a user can turn the faucet on and off by placing the user's hand in the detection zone 40.

Figure 4:
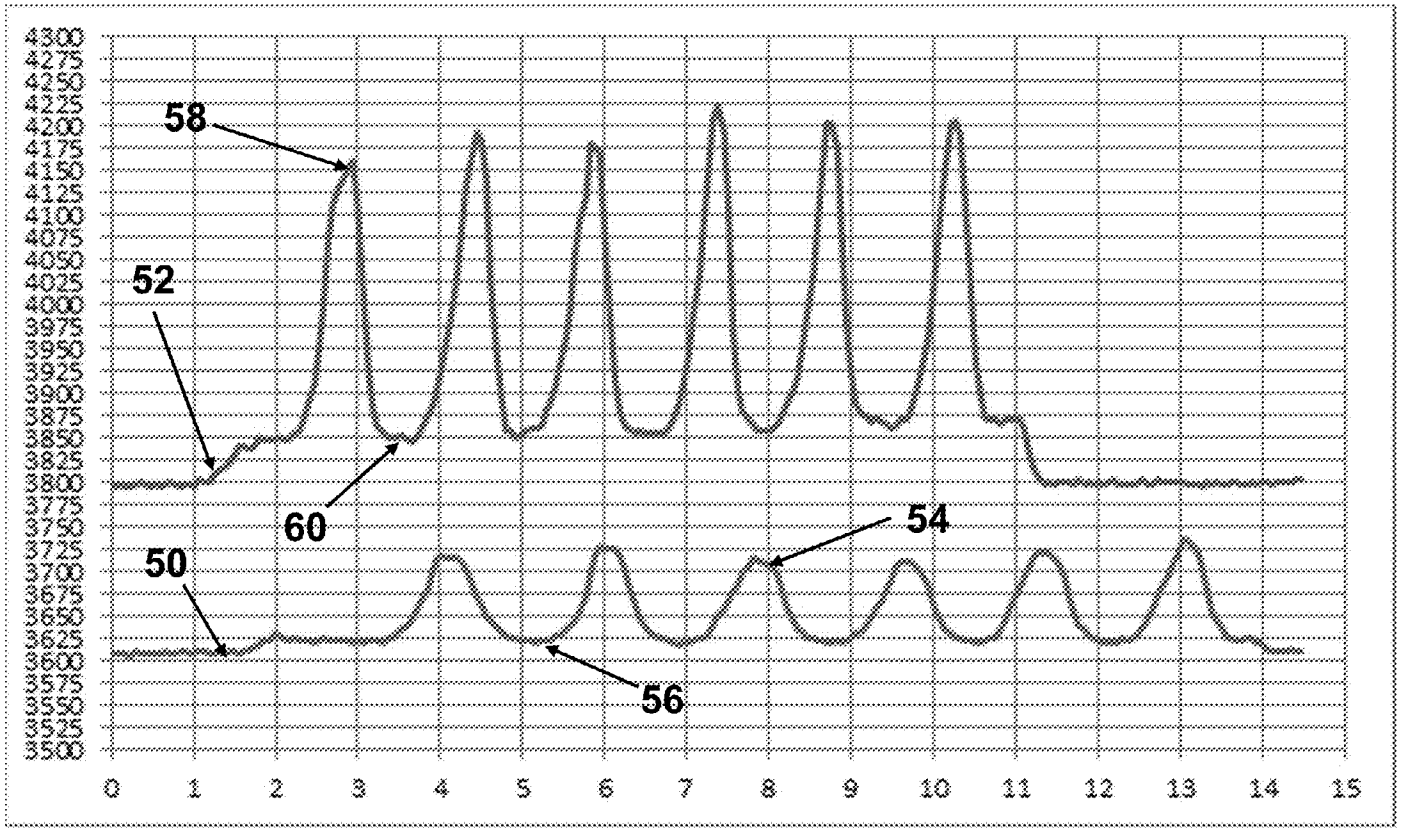
FIG. 4 illustrates exemplary output signals from the first and second capacitive sensors of FIGS. 2 and 3 as a user's hands move relative to the first and second capacitive sensors.

FIG. 4 illustrates output signals from the first and second capacitive sensors 32 and 34 of the embodiment shown in FIGS. 2 and 3 as a user's hands move back and forth between the first and second capacitive sensors 32 and 34. Illustratively, signal 50 is an output from the first capacitive sensor 32, and signal 52 is an output signal from the second capacitive sensor 34. Typically, the output signal 52 from the capacitive sensor 34 mounted on the hub 44 of spout 12 has a greater amplitude than the output signal 50 from the capacitive sensor 32 located near the outlet 48 of spout 12. The peaks 54 of output signal 50 indicate when the user's hands are approaching the first capacitive sensor 32 and the valleys 56 indicate when the user's hands are moving further away from capacitive sensor 32. The peaks 58 in output signal 52 illustrate when the user's hands are moving closer to the second capacitive sensor 34 on hub 44. The valleys 60 indicate when the user's hands have moved further away from the second capacitive sensor 34.

Controller 24 monitors the output signals 50 and 52 to determine when the user's hands are in the detection zone 40. For example, when both the amplitudes of output signals 50 and 52 are within preselected ranges defining the boundaries of the detection zone 40, the controller 24 determines that the user's hands are in the detection zone 40 and opens the valve 22 to begin fluid flow through the spout 12.

Controller 24 determines when the user's hands are in the detection zone 40 by looking at the signal strengths of the output signals 50 and 52 from capacitive sensors 32 and 34, respectively. The stronger the output signal, the closer the user's hands are to that sensor 32 or 34. For example, in FIG. 4 at time 3, the output signal 52 from the second capacitive sensor 34 is strong while the output signal 50 from the first capacitive sensor 32 is weak. This indicates that the user's hands are located closer to the second capacitive sensor 34. At time 8 in FIG. 4, the output signal 52 from the second capacitive sensor 34 is weak and the output signal 50 from the first capacitive sensor 32 is strong. This indicates that that the user's hands are located closer to the first capacitive sensor 32. At time 6 in FIG. 4, both output signals 50, 52 are strong. This indicates that the user's hands are located in the middle of detection zone 40.

Figure 5:
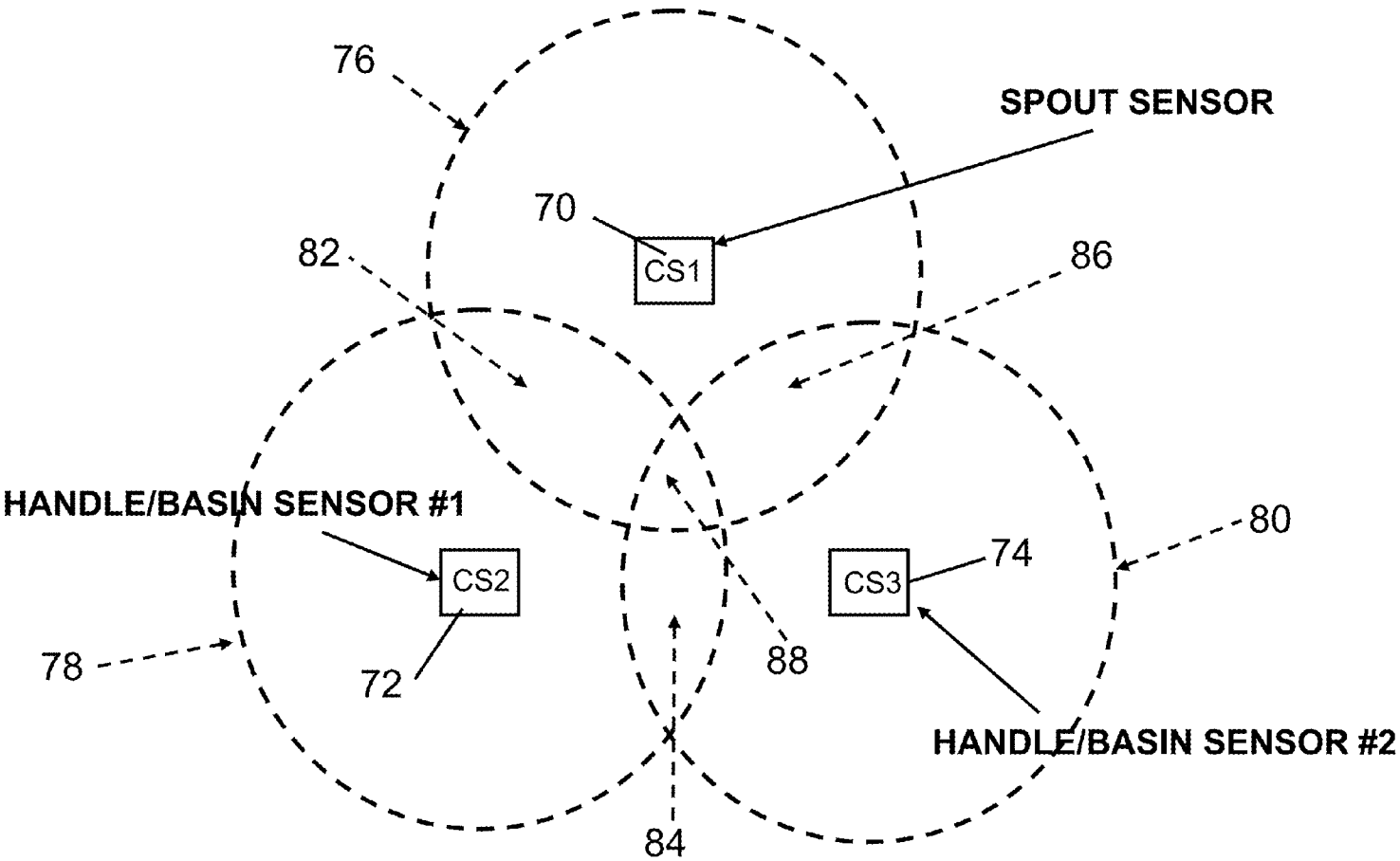
FIG. 5 is a block diagram illustrating another embodiment of the present disclosure including three capacitive sensors each having separate detection fields positioned to define a plurality of overlapping detection zones.

Another embodiment of the present disclosure is illustrated in FIG. 5. In this embodiment, first, second and third capacitive sensors 70, 72, and 74 are provided. Capacitive sensors 70, 72, and 74 each have separate detection fields 76, 78, and 80. In an illustrated embodiment, the first capacitive sensor 70 is mounted on a spout 12 of the faucet. The second and third capacitive sensors 72 and 74 are mounted on handles 14, a sink basin, or other location adjacent the spout 12.

In the FIG. 5 embodiment, detection fields 76 and 78 overlap within a detection zone 82. Detection fields 78 and 80 overlap within a detection zone 84. Detection fields 76 and 80 overlap within a detection zone 86. In addition, all three detection fields 76, 78 and 80 overlap within a central detection zone 88. By monitoring the outputs from capacitive sensors 70, 72 and 74, the controller 24 determines whether the user's hands are in one of the detection zones 82, 84, 86 or 88. The controller 24 controls the faucet differently depending on the detection zone 82, 84, 86 or 88 in which the user's hands are located. For example, the controller 24 may increase or decrease fluid flow, increase or decrease temperature, turn on or off fluid flow, or otherwise control the faucet or other components based upon which detection zone 82, 84, 86 or 88 the user's hands are located.

While this disclosure has been described as having exemplary designs and embodiments, the present invention may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains. Therefore, although the invention has been described in detail with reference to certain illustrated embodiments, variations and modifications exist within the spirit and scope of the invention as described and defined in the following claims.

The invention claimed is:

1. A faucet comprising:

a spout including a lower hub and an upper outlet;

a passageway that conducts water flow through the spout;

an electrically operable valve disposed within the passageway and having an opened position, in which water is free to flow through the passageway, and a closed position, in which the passageway is blocked;

a first capacitive sensor coupled to the spout near the upper outlet, the first capacitive sensor having a first detection field that generates a first output signal upon detection of a user's hands in the first detection field;

a second capacitive sensor coupled to the lower hub of the spout, the second capacitive sensor having a second detection field that generates a second output signal upon detection of a user's hands in the second detection field, the first detection field overlapping the second detection field to define a detection zone; and a controller coupled to the first and second capacitive sensors and the electrically operable valve, the controller configured to monitor the signal strengths of the first output signal and the second output signal, and to actuate the electrically operable valve in response to detecting the user's hands within boundaries of the detection zone defined by amplitudes of the first output signal and the second output signal.

2. The faucet of claim 1, wherein the spout includes an upwardly extending portion pivotably mounted to the hub so that the spout swivels about an axis of the upwardly extending portion, the spout further includes a curved portion.

3. The faucet of claim 1, wherein the spout includes an upwardly extending portion supported by the lower hub and a curved portion supported by the upwardly extending portion, and the detection zone is beneath the curved portion of the spout between the upwardly extending portion of the spout and the outlet, the detection zone being in the shape of a prolate spheroid.

4. The faucet of claim 1, wherein the controller toggles the electrically operable valve between the opened position when the user's hands are detected in the detection zone and the closed position when the user's hands are not detected in the detection zone.

5. The faucet of claim 1, further comprising a manual valve disposed within the passageway in series with the electrically operable valve, and a manual handle that controls the manual valve.

6. A faucet comprising:

a spout;

a passageway that conducts water flow through the spout;

an electrically operable valve disposed within the passageway and having an opened position, in which water is free to flow through the passageway, and a closed position, in which the passageway is blocked;

a first capacitive sensor having a first detection field that generates a first output signal upon detection of a user's hands in the first detection field;

a second capacitive sensor having a second detection field that generates a second output signal upon detection of a user's hands in the second detection field, the first detection field overlapping the second detection field to define a detection zone; and a controller coupled to the first and second capacitive sensors and the electrically operable valve, the controller being programmed to actuate the electrically operable valve in response to detecting the user's hands in the detection zone;

a manual valve disposed within the passageway in series with the electrically operable valve; and a manual handle that controls the manual valve;

wherein the first capacitive sensor is coupled to the spout and the second capacitive sensor is coupled to the manual handle to define the detection zone between the spout and the manual handle.

7. A faucet comprising:

a spout;

a passageway that conducts water flow through the spout;

an electrically operable valve disposed within the passageway and having an opened position, in which water is free to flow through the passageway, and a closed position, in which the passageway is blocked;

a first capacitive sensor having a first detection field that generates a first output signal upon detection of a user's hands in the first detection field;

a second capacitive sensor having a second detection field that generates a second output signal upon detection of a user's hands in the second detection field, the first detection field overlapping the second detection field to define a detection zone; and a controller coupled to the first and second capacitive sensors and the electrically operable valve, the controller being programmed to actuate the electrically operable valve in response to detecting the user's hands in the detection zone; and a third capacitive sensor having a third detection field that generates a third output signal upon detection of a user's hands in the third detection field, the thirst detection field overlapping the first and second detection fields to define a plurality of detection zones; and wherein the controller is also coupled to the third capacitive sensor and programmed to determine when the user's hands are in each of the plurality of the detection zones.

8. The faucet of claim 7, wherein the controller is programmed to increase or decrease fluid flow, to increase or decrease temperature of the fluid, and to turn on or off fluid flow based on the detection zone in which the user's hands are located.

* * * * *